US007758728B2

(12) United States Patent
Harwood

(10) Patent No.: US 7,758,728 B2
(45) Date of Patent: Jul. 20, 2010

(54) NEEDLED CORRUGATOR FABRIC WITH PIN SEAM

(75) Inventor: William Harwood, Waycross, GA (US)

(73) Assignee: Voith Patent GmbH, Heidenheim (DE)

( * ) Notice: Subject to any disclaimer, the term of this patent is extended or adjusted under 35 U.S.C. 154(b) by 0 days.

(21) Appl. No.: 11/950,923

(22) Filed: Dec. 5, 2007

(65) Prior Publication Data

US 2008/0230199 A1 Sep. 25, 2008

Related U.S. Application Data

(63) Continuation-in-part of application No. 11/567,591, filed on Dec. 6, 2006, now abandoned.

(51) Int. Cl.
*D21F 7/08* (2006.01)
*D21F 7/10* (2006.01)
*B31F 1/20* (2006.01)
*D21H 27/40* (2006.01)

(52) U.S. Cl. ..... 162/358.2; 162/362; 162/900; 162/904; 156/462; 139/383 AA

(58) Field of Classification Search ..... 162/116, 162/348, 358.1, 358.2, 361, 362, 900–904; 139/383 A, 383 AA; 28/110, 142; 428/57–62, 428/222, 223; 156/205, 462
See application file for complete search history.

(56) References Cited

U.S. PATENT DOCUMENTS 4,186,780 A * 2/1980 Josef et al. ..... 139/383 AA
4,403,632 A * 9/1983 Romanski et al. ..... 139/383 A
4,418,726 A * 12/1983 Josef et al. ..... 139/383 AA
4,786,554 A 11/1988 Baker et al.
5,562,968 A 10/1996 Fry
5,820,959 A * 10/1998 Whittaker ..... 428/61
2005/0124248 A1 * 6/2005 Hyvonen ..... 442/268

FOREIGN PATENT DOCUMENTS

JP 5-009888 1/1993

OTHER PUBLICATIONS

English Language Abstract of JP 5-009888. Jan. 19, 1993.

* cited by examiner

*Primary Examiner*—Eric Hug
(74) *Attorney, Agent, or Firm*—Greenblum & Bernstein, P.L.C.

(57) ABSTRACT

The present invention relates generally to papermaking, and relates more specifically to fabrics employed in making press felts on a paper machine, pulp machine fiber cement belts, and corrugated paper board, or box-board. The invention also relates to the monofilament base of fabric optionally with a needled batt which can provide one or more of the following advantages: hydrolysis resistant materials, providing light weight high strength fabrics, having a high permeability, and soft surface with a high coefficient of friction. The present invention also relates to an integrated loop seam integrated with machine direction yarns of the monofilament base which can provide one or more of the following advantages: extremely stable and flexible corrugator fabric, and the ability to provide a non-marking loop seam.

18 Claims, 11 Drawing Sheets

NEEDLED CORRUGATOR FABRIC WITH PIN SEAM

CROSS-REFERENCE TO RELATED APPLICATION

The instant application is a Continuation-in-Part of U.S. patent application Ser. No. 11/567,591 filed Dec. 6, 2006 now abandoned, the disclosure of which is expressly incorporated by reference in its entirety.

BACKGROUND OF THE INVENTION

1. Field of the Invention

The present invention relates generally to papermaking, and relates more specifically to fabrics employed in making press felts on a paper machine, pulp machine fiber cement belts, and corrugated paper board, or box-board. The invention also relates to the monofilament base of fabric optionally with a needled batt which can provide one or more of the following advantages: hydrolysis resistant materials, providing light weight high strength fabrics, having a high permeability, and soft surface with a high coefficient of friction. The present invention also relates to an integrated loop seam integrated with machine direction yarns of the monofilament base which can provide one or more of the following advantages: extremely stable and flexible corrugator fabric, and the ability to provide a non-marking loop seam.

2. Discussion of Background Information

On corrugator box-board machine, there is a transformation from sheets of linerboard paper and corrugating medium paper into corrugated box-board. This is achieved by the application of a liquid adhesive to the three sheets of paper and the pressing by one or more corrugator belts, woven or needled or a combination thereof, onto a series of steam heated plates to dry the adhesive, thereby "gluing" the paper assembly together. The heat from the plates is conducted directly to the "glued paper" (corrugated boxboard) and through this into the corrugator belt. As well as this drying function, the belt must pass the corrugator boxboard through the cooling section and onto the next stage. Frictional forces between the corrugator belt, specifically the face, or boardside thereof, and the corrugated paper board are primarily responsible for pulling the latter through the machine.

During the papermaking process, a cellulosic fibrous web is formed by depositing a fibrous slurry, that is, an aqueous dispersion of cellulose fibers, onto a moving forming fabric in the forming section of a paper machine. A large amount of water is drained from the slurry through the forming fabric, leaving the cellulosic fibrous web on the surface of the forming fabric.

The newly formed cellulosic fibrous web proceeds from the forming section to a press section, which includes a series of press nips. The cellulosic fibrous web passes through the press nips supported by a press fabric, or, as is often the case, between two such press fabrics. In the press nips, the cellulosic fibrous web is subjected to compressive forces which squeeze water therefrom, and which adhere the cellulosic fibers in the web to one another to turn the cellulosic fibrous web into a paper sheet. The water is accepted by the press fabric or fabrics and, ideally, does not return to the paper sheet.

The paper sheet finally proceeds to a dryer section, which includes at least one series of rotatable dryer drums or cylinders, which are internally heated by steam. The newly formed paper sheet is directed in a serpentine path sequentially around each in the series of drums by a dryer fabric, which holds the paper sheet closely against the surfaces of the drums. The heated drums reduce the water content of the paper sheet to a desirable level through evaporation. It should be appreciated that the forming, press and dryer fabrics all take the form of endless loops on the paper machine and function in the manner of conveyors. It should further be appreciated that paper manufacture is a continuous process which proceeds at considerable speeds. That is to say, the fibrous slurry is continuously deposited onto the forming fabric in the forming section, while a newly manufactured paper sheet is continuously wound onto rolls after it exits from the dryer section.

Contemporary fabrics are produced in a wide variety of styles designed to meet the requirements of the paper machines on which they are installed for the paper grades being manufactured. Generally, they comprise a woven or other type base fabric. Additionally, as in the case of fabrics used in the press section, the press fabrics have one or more base fabrics into which has been needled a batt of fine, non-woven fibrous material. The base fabrics may be woven from monofilament, plied monofilament, multifilament or plied multifilament yarns, and may be single-layered, multi-layered or laminated. The yarns are typically extruded from any one of the synthetic polymeric resins, such as polyamide and polyester resins, used for this purpose by those of ordinary skill in the paper machine clothing arts.

The woven base fabrics themselves take many different forms. For example, they may be woven endless, or flat woven and subsequently rendered into endless form with a woven seam. Alternatively, they may be produced by a process commonly known as modified endless weaving, wherein the widthwise edges of the base fabric are provided with seamin loops using the machine-direction (MD) yarns thereof In this process, the MD yarns weave continuously back-and-forth between the widthwise edges of the fabric, at each edge turning back and forming a seaming loop. A base fabric produced in this fashion is placed into endless form during installation on a paper machine, and for this reason is referred to as an on-machine-seamable fabric. To place such a fabric into endless form, the two widthwise edges are brought together, the seaming loops at the two edges are interdigitated with one another, and a seaming pin or pintle is directed through the passage formed by the interdigitated seaming loops.

Further, the woven base fabrics may be laminated by placing at least one base fabric within the endless loop formed by another, and by needling a staple fiber batt through these base fabrics to join them to one another as in the case of press fabrics. One or more of these woven base fabrics may be of the on-machine-seamable type. This is now a well known laminated press fabric with a multiple base support structure.

In any event, the fabrics are in the form of endless loops, or are seamable into such forms, having a specific length, measured longitudinally therearound, and a specific width, measured transversely thereacross.

Reference is now made more specifically to industrial fabrics used in the manufacture of corrugated paper board, or box-board, on corrugator machines. Such an industrial fabric is used to form corrugator belts. On corrugator machines, corrugator belts support and pull a sheet of liner board and a sheet of paper board which pass over a roll which adds flutes or CD corrugations to the paperboard sheet. Then these at least two paperboard sheets supported by one or more belts are passed first through a heating zone, where an adhesive used to bond the at least two layers of the board together is dried and cured, and then through a cooling zone. Frictional forces between the corrugator belt, specifically the face, or board, side thereof, and the corrugated paper board are primarily responsible for pulling the latter through the machine.

Corrugator belts should be strong and durable, and should have good dimensional stability under the conditions of tension and high temperature encountered on the machine. The belts must also be comparatively flexible in the longitudinal, or machine, direction, while having sufficient rigidity in the cross-machine direction to enable them to be guided around their endless paths. Traditionally, it has also been desirable for the belts to have porosities sufficient to permit vapor to pass freely therethrough, while being sufficiently incompatible with moisture to avoid the adsorption of condensed vapor which might rewet the surfaces of the corrugated paper product.

As implied in the preceding paragraph, a corrugator belt takes the form of an endless loop when installed on a corrugator machine. In such form, the corrugator belt has a face, or boardside, which is the outside of the endless loop, and a machine side, which is the inside of the endless loop. Frictional forces between the machine side of the belt and the drive rolls of the corrugator machine move the corrugator belt, while frictional forces between the faceside and the sheet of corrugated board pull the sheet through the machine.

Corrugator belts are generally flat-woven, multi-layered fabrics, each of which is woven to size or trimmed in the lengthwise and widthwise directions to a length and width appropriate for the corrugator machine on which it is to be installed. The ends of the fabrics are provided with seaming means, so that they may be joined to one another with a pin, pintle, or cable when the corrugator belt is being installed on a corrugator machine.

On corrugator box-board machines, there is a transformation from sheets of linerboard paper and corrugating medium paper into corrugated box-board. This is achieved by the application of a liquid adhesive to the three sheets of paper and the pressing by one or more corrugator belts, woven or needled or a combination thereof onto a heating zone. In a typical corrugator machine, the heating zone comprises a series of steam-heated plates to dry the adhesive thereby "gluing" the paper assembly together, and the sheet of corrugated board is pulled by the corrugator belt. A plurality of weighted rollers within the endless loop formed by the corrugator belt press the corrugator belt toward the hot plates, so that the corrugator belt may pull the sheet across the hot plates under a selected amount of pressure. The weighted rollers ensure that the sheet will be firmly pressed against the hot plates, and that frictional forces between the corrugator belt and the sheet will be sufficiently large to enable the belt to pull the sheet. As well as this drying function, the belt must pass the corrugated box-board through the cooling section and onto the next stage.

In view of the description noted above, corrugator belts must possess certain features such as strength, durability, be dimensionally stable, and have a non-marking seam under all the conditions of high temperature steam, plus high tension. Furthermore, the belts should be flexible in the machine direction yet be sufficiently stable in the cross machine direction so as to maintain close to the belt's original dimensions and facilitate the ability to be guided along its passage around the machine under the conditions described. More importantly, the belts should be sufficiently permeable to allow the evaporation of vapor to pass easily through the material so as not to rewet the corrugated box-board.

However, corrugator belts exhibiting all of the above desirable features have heretofore not been available. Conventional corrugator belts exhibited low permeability and used the principle of adsorption and then evaporation but problems of rewetting the corrugated box-board occurred which means the corrugator machine was restricted to speed because drying was being restricted. Moreover, these types of belts were typically heavy and very low in permeability.

SUMMARY OF THE INVENTION

The fabric disclosed herein addresses these needs explained above.

The present invention relates to a fabric including: a monofilament woven base woven in a machine direction and a cross direction substantially transverse to the machine direction, wherein the fabric comprises a non-marking loop seam integrated with machine direction yarns.

The fabric can further include a needled batt in a density of about 3.3 decitex to about 100 decitex.

The batt can be constructed of at least one of nylon and PET.

The monofilaments in the monofilament woven base can have a diameter of about 0.1 mm to about 2.0 mm.

The monofilaments in the monofilament woven base can have a diameter different in a machine direction than in a cross direction.

The monofilament woven base can contain 1 to 10 layers of cross machine direction yarns.

The fabric can have a permeability of about 20 cfm to about 500 cfm.

The monofilament woven base can be treated on at least one of a machine side or a corrugator side with a resin.

The monofilament woven base can be constructed of at least one of polyester, nylon, PPS, PET, or PEEK.

The fabric can be is a corrugator fabric, press felt fabric, or pulp machine fiber cement fabric.

The present invention relates to a machine including: a fabric including a monofilament woven base woven in a machine direction and a cross direction substantially transverse to the machine direction comprising a non-marking loop seam integrated with machine direction yarns.

The fabric can further include a needled batt having a density of about 3.3 decitex to about 100 decitex.

The batt can be constructed of at least one of nylon and PET.

The monofilaments in the monofilament woven base can have a diameter of about 0.1 mm to about 2.0 mm.

The monofilaments in the monofilament woven base can have a diameter is different in a machine direction than in a cross direction.

The monofilament woven base can contain 1 to 10 layers of cross machine direction yarns.

The fabric can have a permeability of about 20 cfm to about 500 cfm.

The woven base can be treated on at least one of a machine side or a corrugator side with a resin.

The machine can be a corrugator machine, press felt machine, or pulp machine.

The monofilament woven base can be constructed of at least one of polyester, nylon, PPS, PET, or PEEK.

Other exemplary embodiments and advantages of the present invention may be ascertained by reviewing the present disclosure and the accompanying drawings.

BRIEF DESCRIPTION OF THE DRAWINGS

The present invention is further described in the detailed description which follows, in reference to the noted plurality of drawings by way of non-limiting examples of preferred embodiments of the present invention, in which like numerals represent like elements throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Preliminarily, it is noted that while the discussion of the present invention may refer specifically to corrugator fabrics, the present invention has applicability to other fabrics in the papermaking industry and other industrial applications. For example, the fabrics of the present invention can be used in press felts on a paper machine, or pulp machine fiber cement belts. Additional applications include industrial corrugated fabrics. Fabric constructions include woven, spiral wound, knitted, extruded mesh, spiral-link, spiral coil and other non-woven fabrics. These fabrics may comprise monofilament, plied monofilament, multifilament or plied multifilament yarns, and may be single-layered, multi-layered or laminated. The yarns are typically extruded from any one of the synthetic polymeric resins, such as polyamide and polyester resins, used for this purpose by those of ordinary skill in the industrial fabric arts.

Further, when an amount, concentration, or other value or parameter, is given as a list of upper preferable values and lower preferable values, this is to be understood as specifically disclosing all ranges formed from any pair of an upper preferred value and a lower preferred value, regardless whether ranges are separately disclosed.

Figure 1:
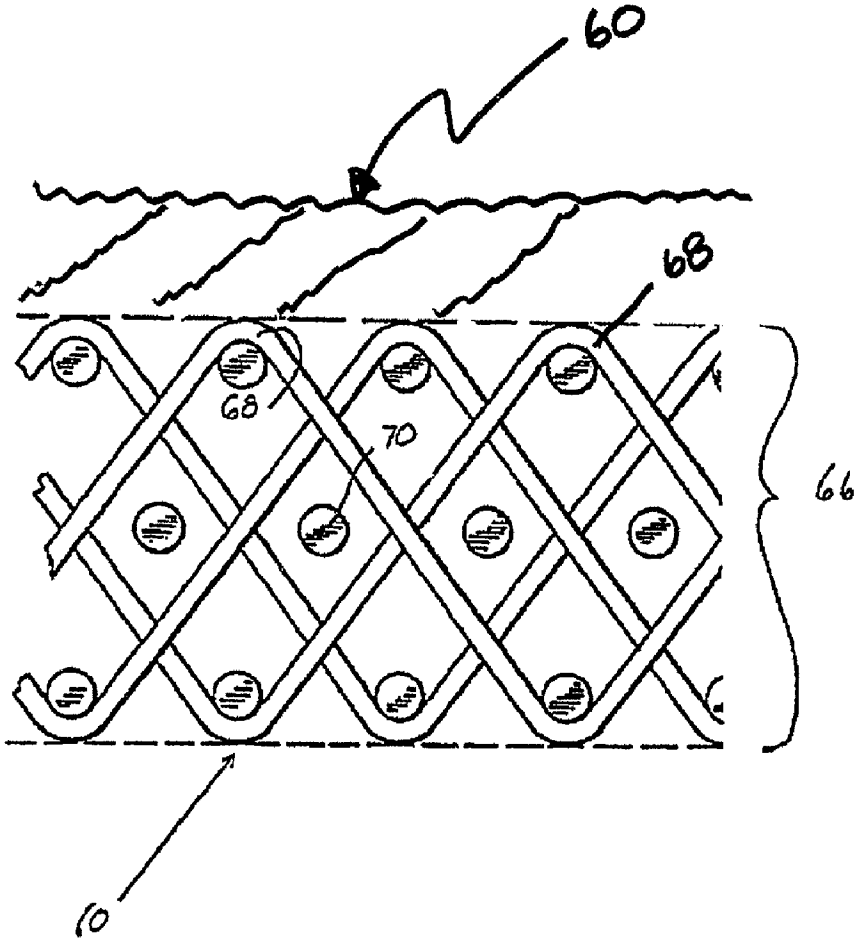
FIG. 1 depicts an embodiment of the present invention showing a cross sectional view of the belt taken in the longitudinal or warpwise direction.
Figure 2:
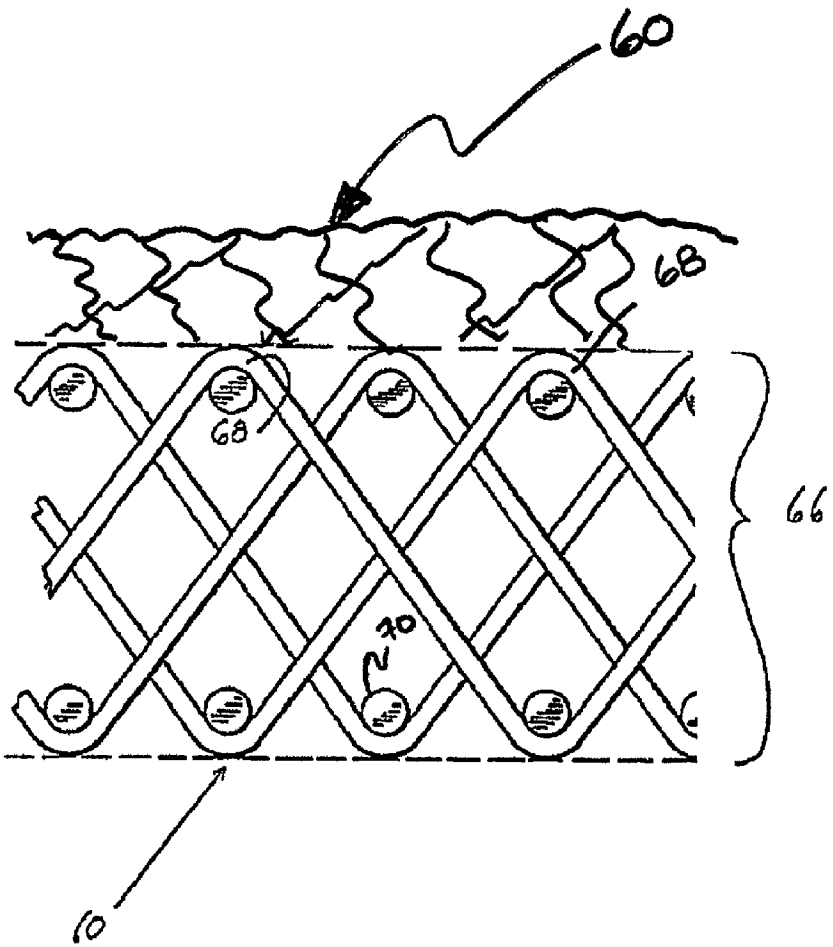
FIG. 2 depicts an embodiment of the present invention showing a cross sectional view of the belt taken in the longitudinal or warpwise direction.
Figure 3:
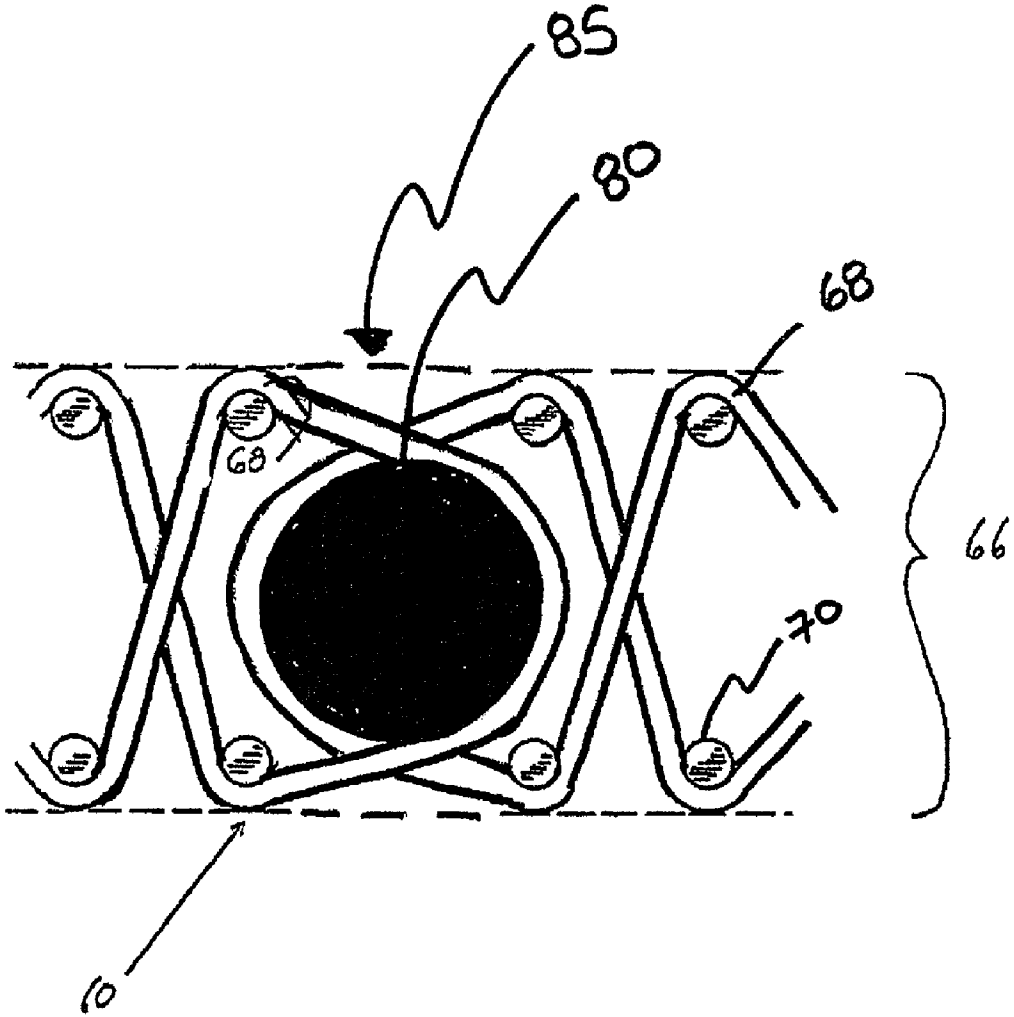
FIG. 3 depicts an embodiment of the present invention showing a cross sectional view of the belt and pin seam taken in the longitudinal or warpwise direction.

FIGS. 1-3 are cross sections of the belt of the present invention where the cross section is taken in the taken in the longitudinal or warpwise direction (machine direction (MD)) of belt, and shows that belt includes a base structure fabric 66, which includes MD yarns 68 and cross machine-direction (CMD) yarns 70. As shown in at least FIGS. 1-3, the base structure fabric 66 may be woven from longitudinal, or machine direction (MD), yarns 68 and transverse, or CMD, yarns 70. Base structure fabric 66 is depicted as having been woven flat providing at least one running surface 10, where longitudinal yarns 68 warp and weave over, under and between the stacked pairs of CMD yarns 70 in a duplex weave and joined to form an endless belt. It should be understood, however, that base structure fabric 66 may be woven endless. It should be further understood that base structure fabric 66 may be woven in a single-layer weave, or in any other weave suitable for the purpose.

By way of non-limiting example, FIG. 1 depicts a fabric having three layers of CMD yarns 70. However, any number of layers of monofilament are contemplated by the present invention and can be determined, for example, by the desired weight and strength of the fabric, in addition to the desired permeability. Thus, one having ordinary skill in the art would readily modify the number of layers in view of any number of parameters, such as belt length, weight requirements, air flow requirements, and type of board, among other things. By way of non-limiting example, the fabric has from 1 to 10 layers of CMD yarns 70, preferably from 1 to 4 layers of CMD yarns 70, and most preferably from 1 to 3 layers of CMD yarns 70. By way of non-limiting example, FIG. 2 depicts a fabric having two layers of CMD yarns 70.

The base structure fabric 66, which includes MD yarns 68 and CMD yarns 70, can be a monofilament made of or extruded from a polymeric resin material, or any other material used in the manufacture of paper machine clothing and industrial process fabrics. Thus, by way of non-limiting example, the monofilament base structure fabric 66 may be woven, or otherwise assembled, from warp yarns and weft yarns comprising yarns of any of the varieties used in the manufacture of paper machine clothing and industrial process fabrics. Thus, by way of non-limiting example, base structure fabric 66 may include natural or metal yarns, monofilament, plied monofilament, multifilament, plied multifilament or yarns spun from staple fibers of any of the synthetic polymeric resins used by those skilled in the art in the manufacture of fabrics intended for use in high-temperature environments. For example, the base structure fabric 66 may be manufactured from any combination of yarns of the following materials: nylon; polyaramids, such as Nomex®, and Kevlar®; polyphenylene sulfide (PPS), which is more commonly known as Ryton®; an aromatic polyester, which is commonly known as VECTRAN®; polyetheretherketone (PEEK); polybutylene terephthalate; polyethylene terephthalate (PET); polyester and blends thereof, such as for example, Synstrand's WFP-905 polyester yarn.

By way of non-limiting example, the base structure fabric 66 may comprise yarns of polyester in the machine direction and Ryton® or polyester monofilament yarns in the cross-machine direction. It is contemplated by the present invention to use differing sizes of CMD and MD yarns, and differing materials for CMD and MD yarns. Therefore, by way of non-limiting example, a fabric can be made of MD yarns having a thickness greater than the CMD yarns, or vice versa.

The base structure fabric 66 of the present invention can provide any number of the following advantages, for example: increased drying rates when used on a corrugator machine, reduced steam consumption and energy to drive the fabric, improved guiding, quicker belt changes due to the lighter, thinner fabric, increased stability of the fabric, especially when using monofilament yarns.

In an embodiment of the present invention, the base structure fabric 66 can be composed of monofilament yarns, with a diameter of approximately 0.1 mm to approximately 2.00 mm diameter, preferably approximately 0.2 mm to approximately 0.6 mm diameter, and most preferably approximately 0.3 mm to approximately 0.5 mm diameter.

Another aspect of the present invention is the incorporation of a non-marking pin seam 85 which includes pin 80 woven into MD yarns, wherein the yarns in the MD form the seam loops, and the seam loops are formed by MD yarns that are completely in-line with the base weave. By way of non-limiting example, FIG. 3 depicts a pin seam 85 which includes pin 80 integrated with the MD yarns 68. The pin 80 of the present invention can be made of any material with sufficient strength to hold together the belt of the present invention. By way of non-limiting example, the pin 80 can be formed of polyester, and further by way of non-limiting example, the pin seam has a diameter smaller than the overall thickness of the base structure fabric 66. By way of a non-limiting example, the pin 80 can include a plurality of pins Advantages of having pin seam 85 including pin 80 integrated with the MD yarns include: having a tension line completely in the central zone thereby substantially elimination the chance of marking from uneven pressure. In addition, the permeability in the seam area is preferably not lower than the body of the fabric, i.e., the seam loops and base material of the fabric are substantially the same diameter, plus the batt in the vicinity of the pin seam is substantially the same as the needled cover on the base material.

By way of non-limiting example, the seam loops are formed at the sides of the fabric by the weft on the loom. The weft on the loom becomes the machine direction (MD) on the corrugator or paper machine and the warp on the loom becomes the cross machine direction (CMD), i.e., the fabric is woven with the length of the fabric determined by the width in the loom.

In addition, when a batt 60 is provided on the base fabric of the present invention, the batt 60 creates the necessary softness and friction desired for all kinds of boxboard production. It should be noted that the fabric of the present invention is unlike any traditional needled fabrics which have a non monofilament base structure (skeleton). Traditional fabrics have a very low permeability (e.g., less than 50 cfm). However, because fabric of the of the present invention can be constructed of a very strong monofilament base, there is no need to needle as much batt onto the base structure to obtain the necessary stability for boxboard production. Therefore, the permeability of the monofilament base corrugator fabric of the present invention can be as much as 4 to 10 times higher in permeability than conventional corrugator fabrics.

By way of non-limiting example, the permeability of the fabric of the present invention (including batt 60) is in the range of approximately 20 to approximately 500 cfm, and preferably approximately 40 cfm to approximately 200 cfm, and most preferably approximately 50 cfm to approximately 100 cfm.

The base structure fabric 66 can optionally be treated with a resin (e.g., EWR resin by Voith Paper) such that when the base structure fabric 66 is mounted on a machine, either the board side of the belt, machine side of the belt, or both sides of the belt, contain a protective resin coating.

By way of further non-limiting example, the permeability of the fabric of the present invention (including batt 60) is in the range of approximately 25 to approximately 500 cfm, and preferably approximately 100 cfm to approximately 400 cfin, and most preferably approximately 150 cfm to approximately 300 cfin.

Further, the base structure fabric 66 can optionally be treated with EWR resin, e.g., 0-10% of this polyurethane resin, such that when the base structure fabric 66 is mounted on a machine, either the board side of the belt, machine side of the belt, or both sides of the belt, contain a protective resin coating.

One or both sides of the base structure fabric 66 may be needled with a web of staple fiber material such as batt 60 in such a manner that the fibers are driven into the structure of the base structure fabric 66. One or more layers of batt 60, may be needled into one or both sides of the base structure fabric 66, and the web of the batt may extend partially or completely through the base structure fabric 66. The batt used for this purpose may be of nylon, PET, polyester, polypropylene, polyamide, acrylic fibers.

By way of non-limiting example, the batt 60 is provided on the base structure fabric 66 in a range of approximately 3.3 to approximately 100 decitex, and preferably approximately 14 to approximately 44 decitex. The batt 60 can be applied to the base structure, such that when the base structure fabric 66 is mounted on a machine, either the board side of the belt, machine side of the belt, or both sides of the belt, contain batt, as shown by way of non-limiting example in FIGS. 1-2 and 5-9. It should be noted that batt 60 is not shown in FIG. 3 for the sake of clarity, but the present invention contemplates using batt 60 in the vicinity of pin seam 85.

Figure 4:
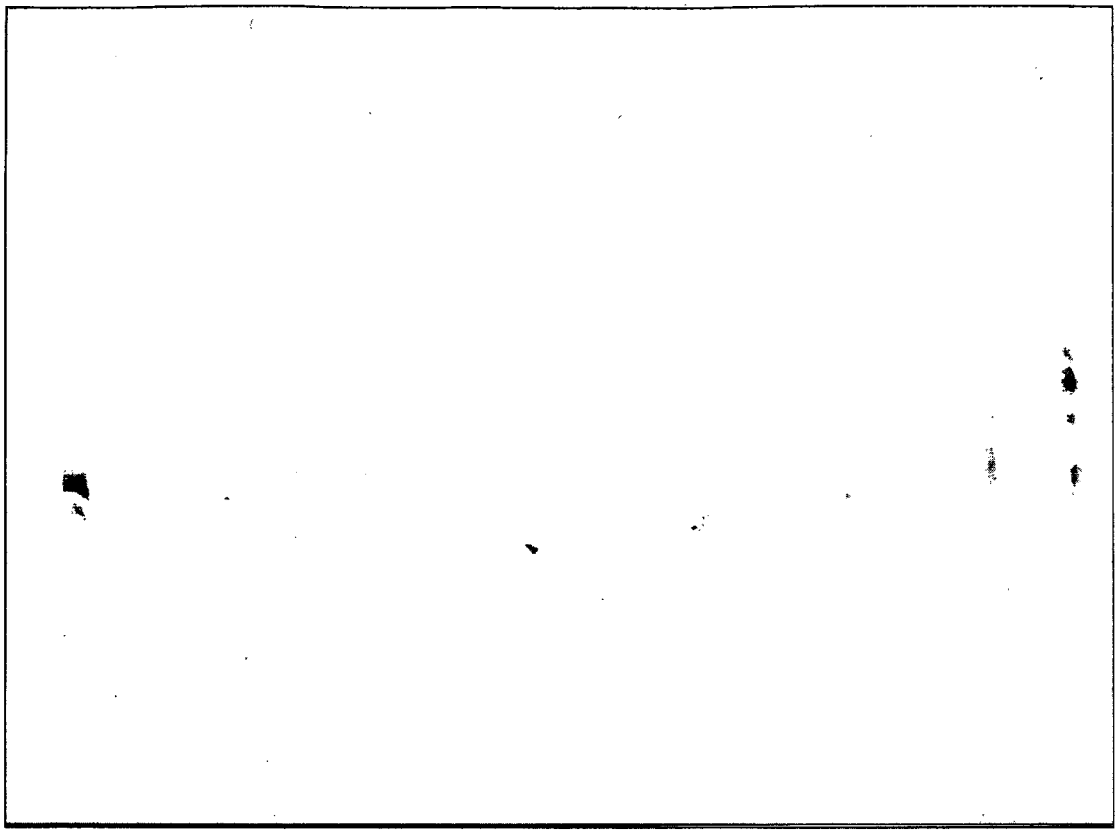
FIG. 4 is a photograph of an embodiment of the present invention revealing the seam loops with a flap of batt pulled back.

By way of non-limiting example, FIG. 4 represents a photograph of an embodiment of the present invention revealing the seam loops with a flap of batt pulled back.

Figure 5:
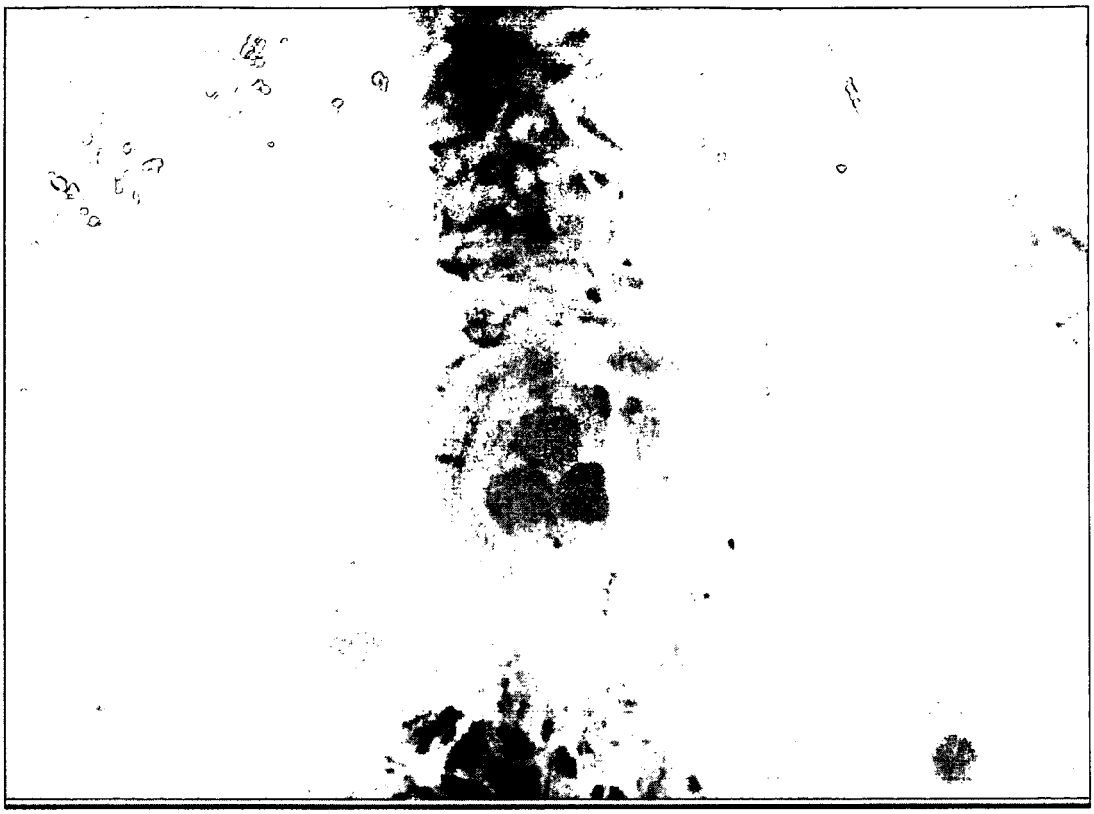
FIG. 5 is a photograph of an embodiment of the present invention showing the seam with the needled flap depicting the integral nature of the design.

By way of non-limiting example, FIG. 5 represents a photograph of an embodiment of the present invention showing the seam with the needled flap depicting the integral nature of the design.

Figure 6:
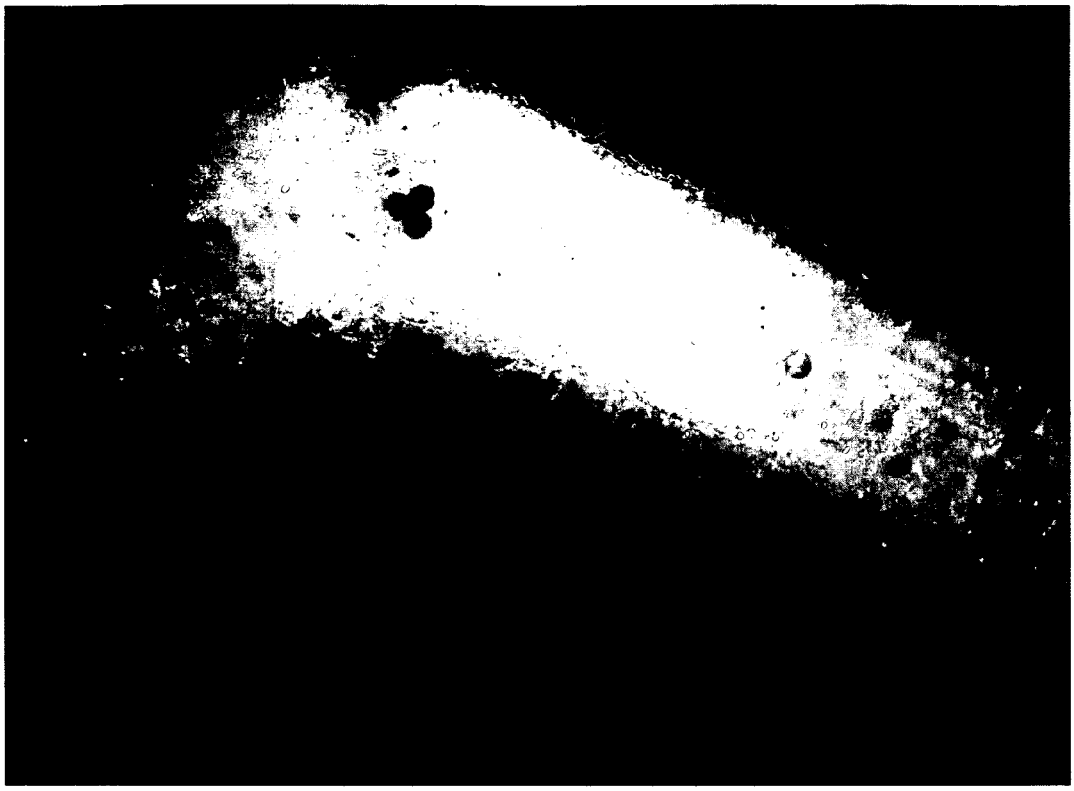
FIGS. 6-8 are photographs of embodiments of the present invention showing the monofilament base weave, the joined seam loops, and the batt.
Figure 7:
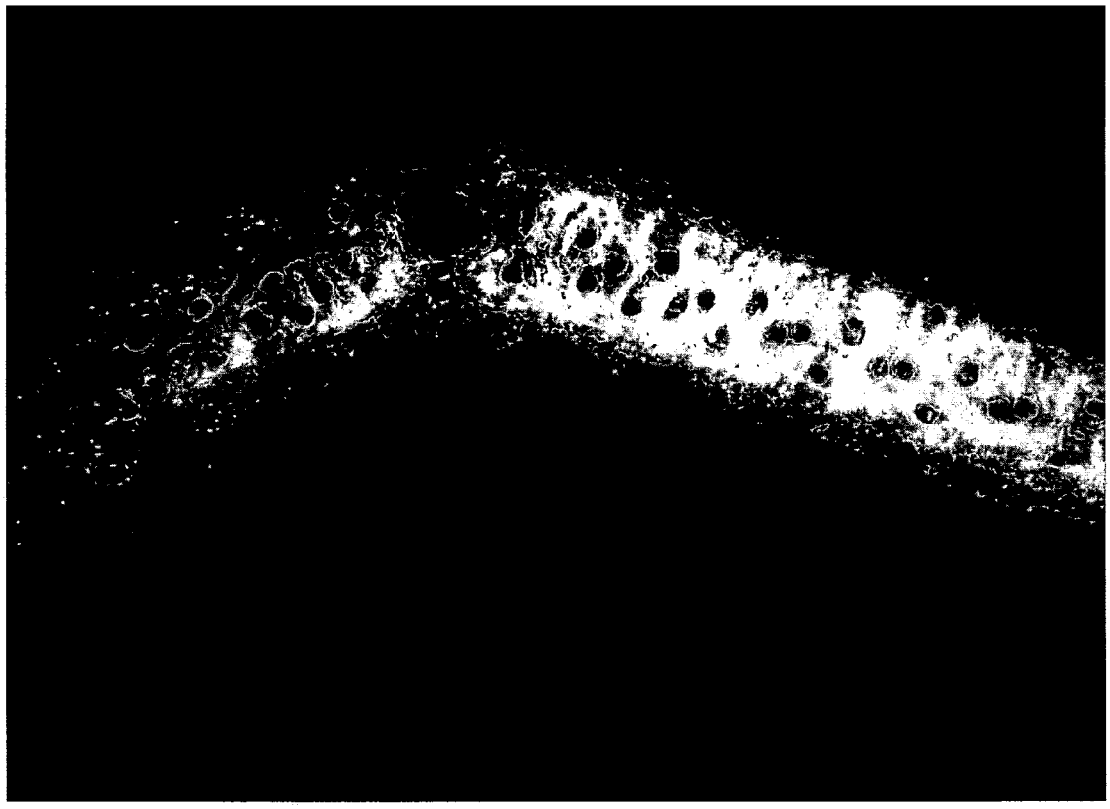
Figure 8:
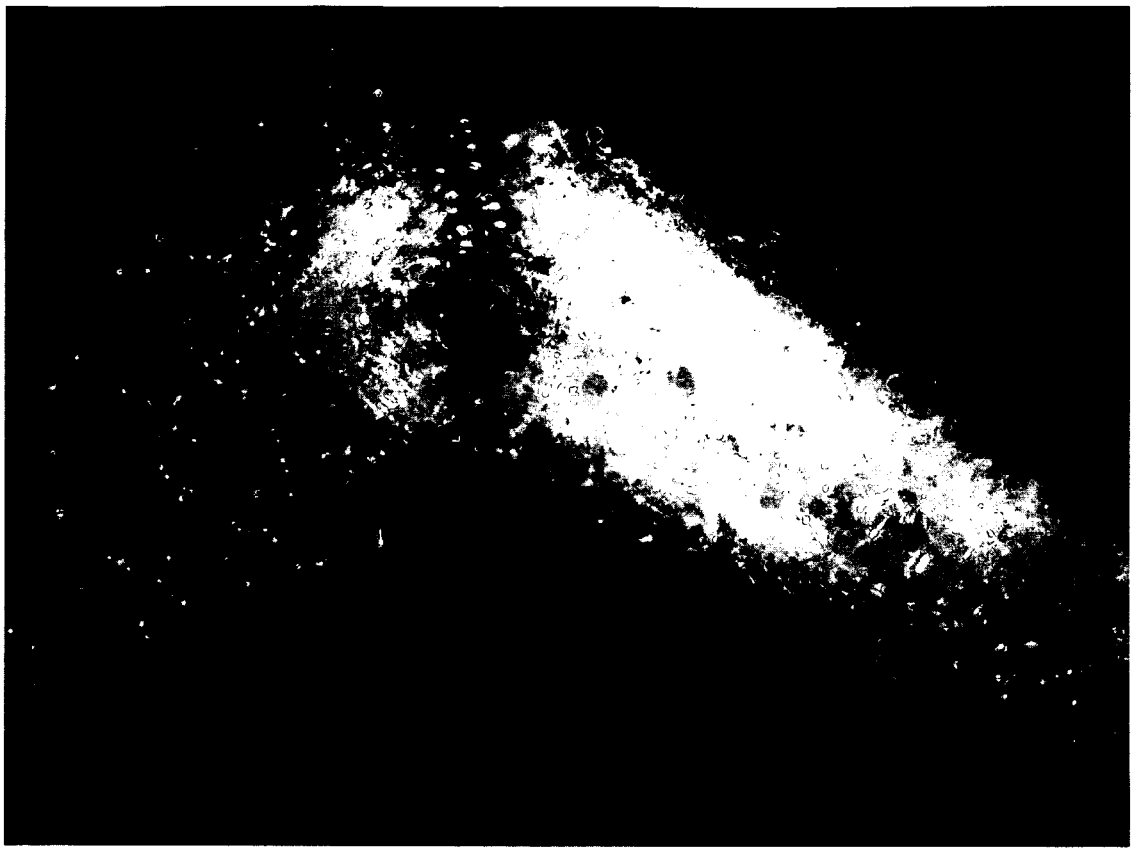

By way of non-limiting example, FIGS. 6-8 represents photographs of embodiments of the present invention showing the monofilament base weave, the joined seam loops, and the batt.

Figure 9:
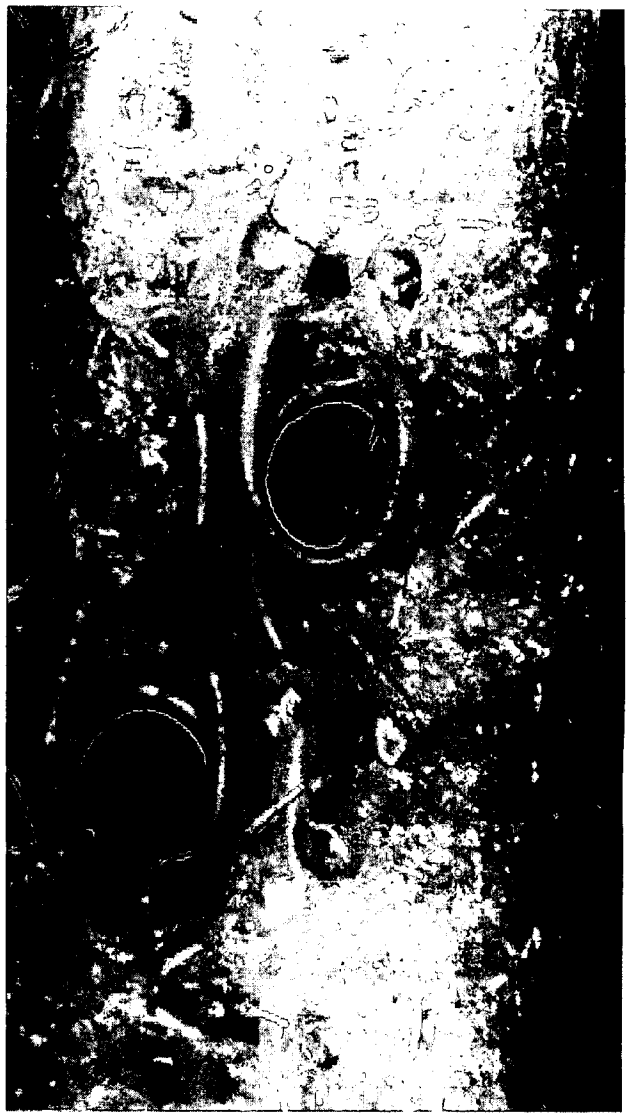
FIG. 9 is a photograph of an embodiment of the present invention showing a double loop seam to give extra strength by the utilization of two base monofilament weaves.

By way of non-limiting example, FIG. 9 represents a photograph of an embodiment of the present invention showing a double loop seam to give extra strength by the utilization of two base monofilament weaves.

Figure 10:
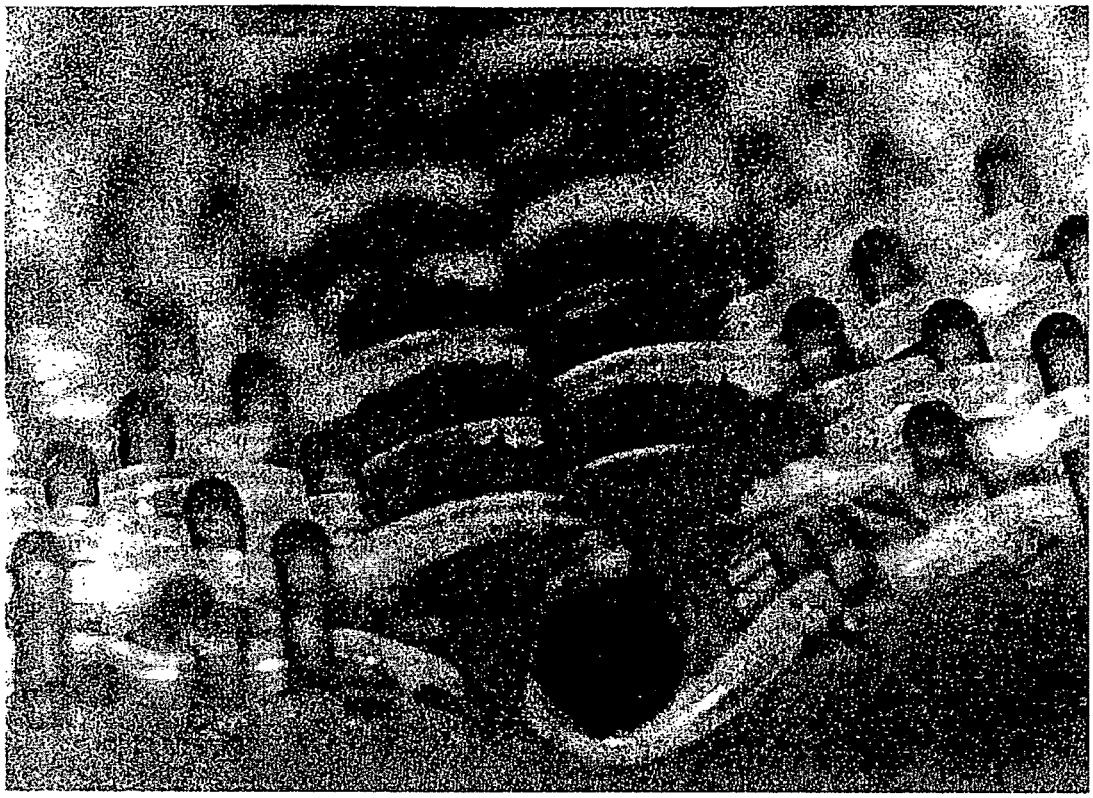
FIG. 10 is a photograph of an embodiment of the present invention showing the base monofilament weave plus the seam loops before needling the batt onto the belt.

By way of non-limiting example, FIG. 10 represents a photograph of an embodiment of the present invention showing the base monofilament weave plus the seam loops before needling the batt onto the belt.

Figure 11:
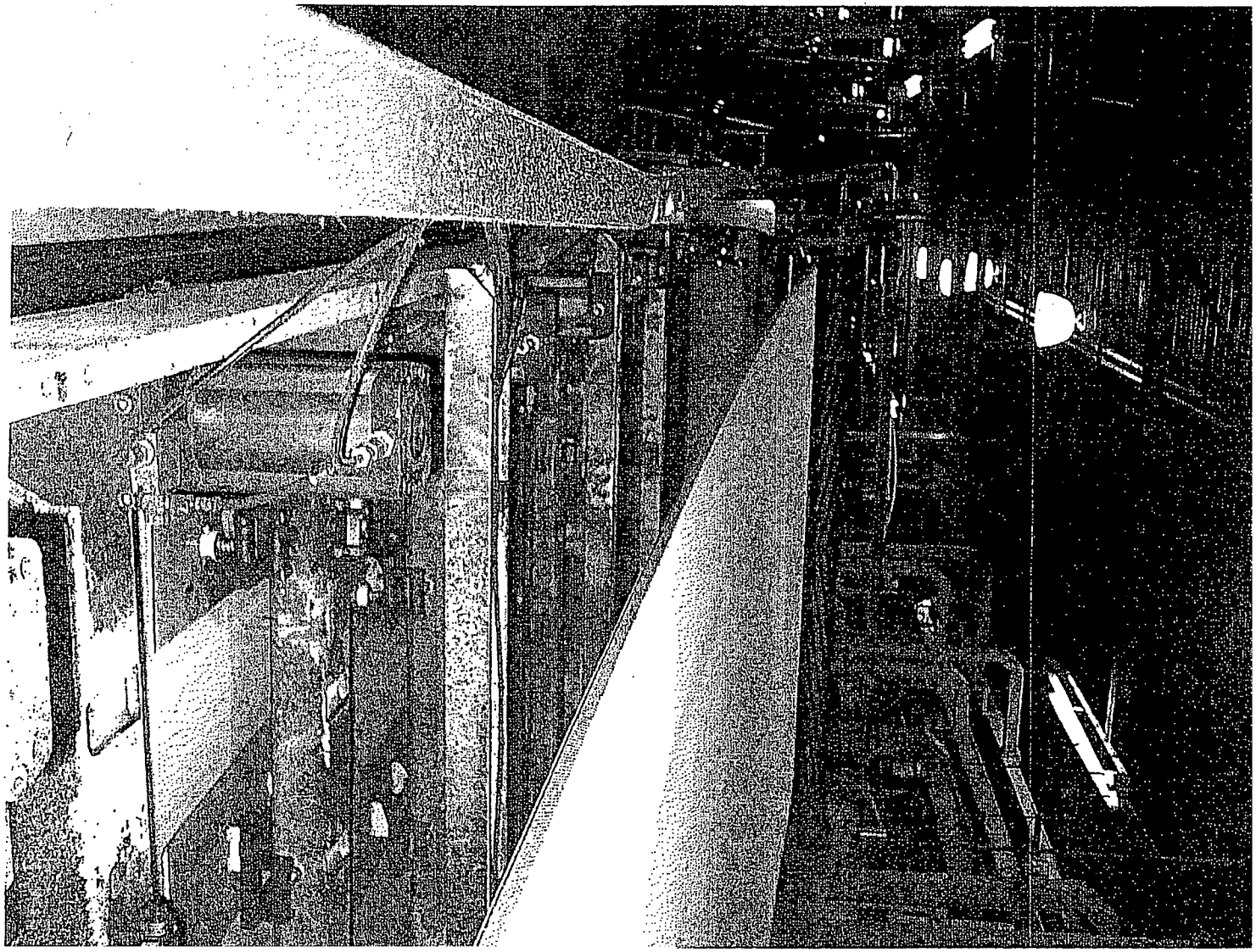
FIG. 11 is a photograph of an embodiment of the present invention showing a corrugator machine with the belt of the present invention and stationary metal shoes on the machine side of the corrugator belt.

By way of non-limiting example, FIG. 11 represents a photograph of an embodiment of the present invention showing a corrugator machine with the belt of the present invention and stationary metal shoes on the machine side of the corrugator belt. It is noted that the belt of the present invention can be used on any corrugator machine, and is also not limited thereto. By way of non-limiting example, the belt can also be used on paper machines used to press felts, and on pulp machines.

Example 1

A fabric for a corrugator machine was constructed using a pin seam which was inserted into a monofilament base using Synstrand WFP-905 polyester MD yarn with a diameter of 0.40 mm. After weaving the monofilament base, a nylon batt was needle punched into the monofilament woven base resulting in a 1900 gsm fabric weight, 0.205" caliper, and 50-100 cfm. The resulting fabric was then treated with a resin (EWR resin, a product of Voith Paper) on the inside (i.e., machine side, for resistance to the stationary metal shoes). The outside (i.e., box-board side) was also lightly resin treated (EWR resin, a product of Voith Paper) to give extra durability to the surface of the corrugator fabric without sacrificing softness to the board.

It is noted that the foregoing examples have been provided merely for the purpose of explanation and are in no way to be construed as limiting of the present invention. While the present invention has been described with reference to exemplary embodiments, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A corrugator fabric comprising:

a needled monofilament woven base woven in a machine direction and a cross direction substantially transverse to the machine direction, wherein the fabric comprises a loop seam integrated with machine direction yarns in-line with the base weave, and wherein the fabric has a permeability of greater than 100 cfm.

2. The fabric according to claim 1, further comprising a needled batt in a density of about 3.3 decitex to about 100 decitex.

3. The fabric according to claim 2, wherein the batt is constructed of at least one of nylon and PET.

4. The fabric according to claim 1, wherein the monofilaments in the monofilament woven base have a diameter of about 0.1 mm to about 2.0 mm.

5. The fabric according to claim 4, wherein the monofilaments in the monofilament woven base have a diameter different in a machine direction than in a cross direction.

6. The fabric according to claim 1, wherein the monofilament woven base contains 1 to 10 layers of cross machine direction yarns.

7. The fabric according to claim 1, wherein the monofilament woven base is treated on at least one of a machine side or a corrugator side with a resin.

8. The fabric according to claim 1, wherein the monofilament woven base is constructed of at least one of polyester, nylon, PPS, PET, or PEEK.

9. The fabric according to claim 1, wherein the permeability of the fabric is less than 400 cfm.

10. A machine comprising:

a corrugator fabric composed of a needled monofilament woven base with a loop seam integrated with machine direction yarns in-line with the base weave, wherein a permeability of the fabric is greater than 100 cfm.

11. The machine according to claim 10, wherein the fabric further comprises a needled batt in a density of about 3.3 decitex to about 100 decitex.

12. The machine according to claim 11, wherein the batt is constructed of at least one of nylon and PET.

13. The machine according to claim 10, wherein the monofilaments in the monofilament woven base have a diameter of about 0.1 mm to about 2.0 mm.

14. The machine according to claim 13, wherein the monofilaments in the monofilament woven base have a diameter different in a machine direction than in a cross direction.

15. The machine according to claim 10, wherein the monofilament woven base contains 1 to 10 layers of cross machine direction yarns.

16. The machine according to claim 10, wherein the monofilament woven base is treated on at least one of a machine side or a corrugator side with a resin.

17. The machine according to claim 10, wherein the monofilament woven base is constructed of at least one of polyester, nylon, PPS, PET, or PEEK.

18. The machine according to claim 10, wherein the permeability of the fabric is less than 400 cfm.

* * * * *